US010718597B2

(12) United States Patent
Wei et al.

(10) Patent No.: US 10,718,597 B2
(45) Date of Patent: Jul. 21, 2020

(54) HETEROGENEOUSLY STACKED MULTI LAYERED METALLIC STRUCTURES WITH ADIABATIC SHEAR LOCALIZATION UNDER UNIAXIAL DYNAMIC COMPRESSION

(71) Applicant: The University Of North Carolina At Charlotte, Charlotte, NC (US)

(72) Inventors: Qiuming Wei, Charlotte, NC (US); Xiaoxue Chen, Mount Holly, NC (US)

(73) Assignee: The University of North Carolina at Charlotte, Charlotte, NC (US)

( * ) Notice: Subject to any disclaimer, the term of this patent is extended or adjusted under 35 U.S.C. 154(b) by 0 days.

(21) Appl. No.: 16/042,178

(22) Filed: Jul. 23, 2018

(65) Prior Publication Data

US 2019/0063889 A1 Feb. 28, 2019

Related U.S. Application Data

(60) Provisional application No. 62/549,701, filed on Aug. 24, 2017.

(51) Int. Cl.
*F42B 12/72* (2006.01)
*C21D 9/16* (2006.01)
(Continued)

(52) U.S. Cl.
CPC ..... *F42B 12/72* (2013.01); *C21D 9/16* (2013.01); *F42B 12/06* (2013.01); *F42B 12/08* (2013.01); *F42B 12/74* (2013.01)

(58) Field of Classification Search
None
See application file for complete search history.

(56) References Cited

U.S. PATENT DOCUMENTS 4,607,515 A 8/1986 Goodfellow
5,440,995 A 8/1995 Levitt
(Continued)

OTHER PUBLICATIONS

Wei, Q., Li Kecskes, and KT Ramesh. "Effect of low-temperature rolling on the propensity to adiabatic shear banding of commercial purity tungsten." Materials science & engineering. A, Structural materials: properties, microstructure and processing 578 (2013): 394-401.

(Continued)

*Primary Examiner* — Reginald S Tillman, Jr.
(74) *Attorney, Agent, or Firm* — Clements Bernard Walker; Christopher L. Bernard

(57) ABSTRACT

The present disclosure is directed to significantly improving the adiabatic shear banding susceptibility of pure refractory metals as well as overcoming the physical dimension limitations when making kinetic energy penetrators. These improvements may be achieved by arranging interlayers between plasticly deformed refractory metal material layers. Disclosed herein are methods of making material for kinetic energy penetrator applications, the methods comprising: severely plasticly deforming a refractory metal material until the grain size of the refractory metal material is within one of ultrafine grain and nanocrystalline regimes; arranging an interlayer material adjacent the refractory metal material; and diffusion bonding the interlayer material to the refractory metal material.

8 Claims, 9 Drawing Sheets

(51) Int. Cl.

| | |
|---|---|
| ***F42B 12/08*** | (2006.01) |
| ***F42B 12/74*** | (2006.01) |
| ***F42B 12/06*** | (2006.01) |

(56) References Cited

U.S. PATENT DOCUMENTS

| | | | | |
|---|---|---|---|---|
| 5,600,989 | A | 2/1997 | Segal et al. | |
| 7,300,708 | B2 * | 11/2007 | Gigliotti, Jr. ..... | B23K 20/08 416/241 B |
| 8,171,851 | B2 | 5/2012 | Siddle et al. | |
| 8,522,687 | B2 | 9/2013 | Liu | |

OTHER PUBLICATIONS

Z. Pan, F Xu, SN Mathaudhu, LJ Kecskesk, WH Yin, XY Zhang, KT Hartwig, Q Wei, "Microstructural evolution and mechanical properties of niobium processed by equal channel angular extrusion up to 24 passes", Acta Materialia, 60 (5), 2310-2323 (2012).

BE Schuster, JP Ligda, ZL Pan, Q Wei, "Nanocrystalline refractory metals for extreme condition applications", JOM, 63 (12), 27-31 (2011).

Q Wei, ZL Pan, XL Wu, BE Schuster, LJ Kecskes, RZ Valiev, "Microstructure and mechanical properties at different length scales and strain rates of nanocrystalline tantalum processed by high pressure torsion", Acta Materialia, 59 (6), 2423-2436 (2011).

YZ Guo, YL Li, Z Pan, FH Zhou, Q Wei, "A numerical study on microstructure effect on adiabatic shear instability: application to nanocrystalline/ultrafine grained materials", Mechanics of Materials, 42 (11), 1020-1029 (2010).

Q. Wei, B. E. Schuster, S.N. Mathaudhu, K.T. Hartwig, L.J. Kecskes, R.J. Dowding and K.T. Ramesh, "Dynamic behaviors of body-centered cubic metals with ultrafine grained and noncrystalline microstructures", Materials Science and Engineering A, vol. 493, Issues 1-2, Oct. 15, 2008, pp. 58-64.

Q. Wei, B. E. Schuster, K. T. Ramesh, R. J. Dowding and L. J.Laszlo, "Nanoengineering opens a new era for tungsten", JOM, 58 (9), 40-44 (2006).

Q. Wei, T. Jiao, K. T. Ramesh, E. Ma, L. J. Kesckes, L. Magness, R. Dowding and R. Z.Valiev, "Mechanical behavior and dynamic failure of ultrafine grained tungsten under uniaxial compression", Acta Mater. 54, 77-87 (2006).

Q. Wei, K. T. Ramesh, E. Ma, L. J. Kesckes R. Dowdingv.U. Kazykhanov and R. Z.Valiev, "Plastic localization in bulk tungsten with ultrafine microstructure", Appl. Phys. Lett. 86, 101907 (2005).

Q. Wei, T. Jiao, K. T. Ramesh and E. Ma, "Nano-structured vanadium: Processing and mechanical properties under quasi-static and dynamic compression", Scripta Mater. 50, 359-364 (2004).

Q. Wei, L. Kecskes, T. Jiao, K. T. Hartwig, K. T. Ramesh and E. Ma, "Adiabatic shear banding in ultrafine-grained Fe processed by severe plastic deformation", Acta Mater. 52, 1859-1869 (2004).

Magness, L.S., High-strain rate deformation behaviors of kinetic-energy penetrator materials during ballistic impact. Mechanics of Materials, 1994. 17(2-3): p. 147-154.

Chen, "Processing and Properties of Materials with or without Adiabatic Shear Susceptibility" (2018).

Wei, Q., et al., Evolution and microstructure of shear bands in nanostructured Fe. Applied Physics Letters, 2002. 81 (7): p. 1240-1242.

Ligda, J., et al., Quasi-static Tensile and Compressive Behavior of Nanocrystalline Tantalum Based on Miniature Specimen Testing—Part II: Mechanical Properties. JOM, 2016: p. 1-8.

Wei, Q., et al., Effect of nanocrystalline and ultrafine grain sizes on the strain rate sensitivity and activation volume: fcc versus bcc metals. Materials Science and Engineering: A, 2004. 381(1): p. 71-79.

Wei, Q., et al., Microstructure and mechanical properties of tantalum after equal channel angular extrusion (ECAE). Materials Science and Engineering a-Structural Materials Properties Microstructure and Processing, 2003. 358(1-2): p. 266-272.

Wei, Q. and L. Kecskes, Effect of low-temperature rolling on the tensile behavior of commercially pure tungsten. Materials Science and Engineering: A, 2008. 491(1): p. 62-69.

Wei, Q., et al., Microstructure and mechanical properties of super-strong nanocrystalline tungsten processed by high-pressure torsion. Acta materialia, 2006. 54(15): p. 4079-4089.

* cited by examiner

HETEROGENEOUSLY STACKED MULTI LAYERED METALLIC STRUCTURES WITH ADIABATIC SHEAR LOCALIZATION UNDER UNIAXIAL DYNAMIC COMPRESSION

CROSS-REFERENCE TO RELATED APPLICATION

The present disclosure claims the benefit of priority of U.S. Provisional Patent Application No. 62/549,701, filed on Aug. 24, 2017, and entitled "HETEROGENEOUSLY STACKED MULTI-LAYERED METALLIC STRUCTURES THAT SHOW ADIABATIC SHEAR LOCALIZATION UNDER UNIAXIAL DYNAMIC COMPRESSION," the contents of which are incorporated in full by reference herein.

FIELD OF THE DISCLOSURE

The present disclosure relates generally to the materials science field. More specifically, the present disclosure relates to systems and methods of fabricating high performance kinetic energy penetrators.

BACKGROUND OF THE DISCLOSURE

Current tank technologies use two main ammunition types for overcoming target armor. The first type is high explosive anti-tank projectiles equipped with an explosively driven warhead, which can penetrate steel armor plating to depths greater than seven times the diameter of the charge. The second type is armor-piercing fin stabilized discarding sabot projectiles equipped with kinetic energy penetrators. Kinetic energy penetrators are long-rod, armor-piercing projectiles that may be fired from modern high-velocity tank guns. These kinetic energy penetrators break through a target's armor by burrowing a cavity through its plating. Thus, armor-piercing fin stabilized discarding sabot ammunition does not contain explosives, but rather uses kinetic energy to damage the target. If the kinetic energy penetrator pierced through the armor, the combination of heat, spalling (particle spray), and the pressure wave generated during the penetration process can destroy the target.

Prior work in the field of the present disclosure has been directed toward replacing depleted uranium in kinetic energy penetrator applications. The density and "self-sharpening" behavior of depleted uranium, in particular, aid in the depth of penetration (and thus, damage) of a kinetic energy penetrator into a target.

Depleted uranium alloys, such as U-3/4Ti and U-8Mo alloys with high mass density (17-18 g/cm$^3$) are highly desired as the penetrator core materials because of their outstanding combination of high strength, optimal and maintained ductility, as well as "self-sharpening" behavior. In the flow and shear failure behavior of depleted uranium alloy penetrators, early onset of adiabatic shear localization may occur at the head of the depleted uranium projectile, which helps discard any material build-up during penetration. Imaging of residual penetrators after perforating steel armor has shown that U-3/4Ti and U-8Mo alloys develop a chiseled and pointed nose, indicating early adiabatic shear failure and this material discard mechanism. However, depleted uranium penetrator materials, although mildly radioactive, derive their toxicity from the biochemical reactions within the human body after inhalation, ingestion, and/or other absorption methods. The uranium may then react to become toxic soluble salts and accumulate in the kidneys and other organs leading to failure or other health defects, such as the symptoms associated with Gulf War syndrome. Therefore, the use of depleted uranium has been restricted, and research for the past half-century has been focused on finding more environmentally friendly substitutes.

As part of this effort to replace depleted uranium alloys in kinetic energy penetrators, tungsten-based heavy alloys have emerged as attractive alternative candidate materials because of their unique combination of elevated temperature properties and high mass density (about 19.3 g/cm$^3$). For example, conventional tungsten-based heavy alloys produced by liquid phase sintering—such as tungsten-nickel-iron (W—Ni—Fe) alloys—have been widely studied as depleted uranium alloy substitutes. However, conventional tungsten-based heavy alloy penetrators do not flow soften as quickly as depleted uranium alloy penetrators. Research in tungsten-based heavy alloy penetrators has shown that plastic localizations develop only after the tungsten-based heavy alloy has undergone very large plastic strains, which produces a large "mushroom" head and thus, reduces the full depth of penetration. This "mushroom" formation on the piercing head forms due to late shear localization and discard mechanisms.

In general, at the same firing velocity, depleted uranium alloy penetrators pierce deeper and generate smaller diameter penetration tunnels in a target as compared with conventional tungsten-based heavy alloy penetrators. Therefore, depleted uranium alloy penetrators have traditionally delivered better ballistic performance across multiple criteria.

Thus, to summarize, although other heavy metals and alloys have been investigated as potential replacements for depleted uranium in kinetic energy penetrators, the late or slow adiabatic shear localization of these replacement heavy metal alloys (such as tungsten-based heavy alloys) causes bulging deformations—which limit the penetration potential of the kinetic energy penetrator due to inefficient kinetic energy conservation during the tunneling process—and leads to failure of ballistic performance tests.

BRIEF SUMMARY OF THE DISCLOSURE

Accordingly, the present disclosure is devoted to improved systems and methods for providing the enhanced material performance of heavy, refractory metal alloys in kinetic energy penetrators. Disclosed herein are the ways in which multiple heterogeneous layers may be produced in kinetic energy penetrator compositions using severely plasticly deformed, pure refractory metals to achieve hierarchical structures, in which the dimensions are extendable, and the products exhibit adiabatic shear localization or banding. For example, heterogeneous layers of iron or vanadium between tungsten may be produced using cold-rolling and diffusion bonding to achieve a dimensionally-flexible multilayer hierarchical structure with adiabatic shear banding.

The systems and methods of the present disclosure allow for an enhanced response to uniaxial compression, including adiabatic shear localization and "self-sharpening" behavior, in pure refractory metals without the use of depleted uranium. More broadly, the present disclosure relates to the development of improved kinetic energy penetrators with heterogeneously stacked layers, exhibiting "self-sharpening" characteristics.

In one exemplary embodiment, the present disclosure provides a method of making material for kinetic energy penetrator applications, the method including: severely plasticly deforming a refractory metal material until the grain size of the refractory metal material is within the ultrafine grain or nanocrystalline regime; arranging an interlayer material adjacent the refractory metal material; and diffusion bonding the interlayer material to the refractory metal material.

In another exemplary embodiment, the present disclosure provides a composition for kinetic energy penetrator applications, the composition including: a refractory metal layer; and an interlayer, adjacent the refractory metal layer, wherein the refractory metal layer exhibits adiabatic shear banding when uniaxial dynamic compression or high strain rate loading is applied.

BRIEF DESCRIPTION OF THE DRAWINGS

The present disclosure is illustrated and described herein with reference to the various drawings, in which like reference numbers are used to denote like device components/method steps, as appropriate, and in which.

DETAILED DESCRIPTION OF THE DISCLOSURE

Figure 1:
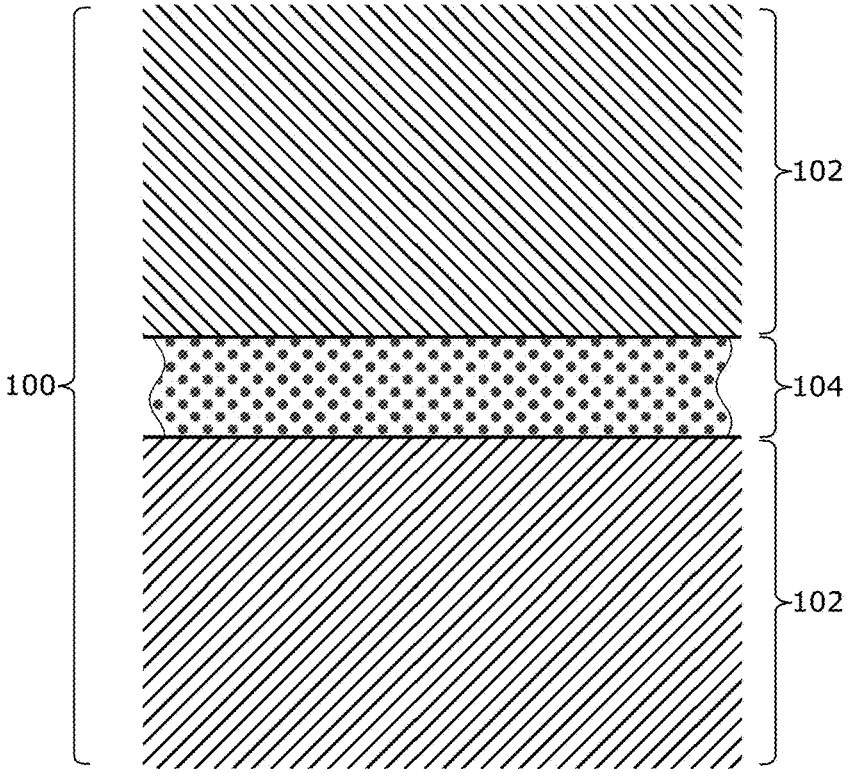
FIG. 1 shows a schematic of a heterogeneous multilayer structure with alternating layers of a refractory metal material and an interlayer material, in accordance with certain embodiments of the disclosed technology.

The present disclosure is directed to significantly improving the adiabatic shear banding susceptibility of pure body-centered-cubic (BCC) lattice structure metals as well as overcoming the physical dimension limitations. These improvements may be achieved by arranging interlayers between plasticly-deformed BCC or refractory metal material layers.

An underlying principle of kinetic energy penetrators is using kinetic energy—a function of the mass and velocity—to force a way through armor. Therefore, to be a good candidate for kinetic energy penetrator applications, a material should exhibit high mass density. For example, tungsten and tantalum are potential kinetic energy penetrator materials due to their high mass density of about 17-19 g/cm$^3$. In general, all of the elements in the class of the refractory metals exhibit a sufficient mass density for use as a kinetic energy penetrator material.

Another key attribute of kinetic energy penetrators is "self-sharpening". The "self-sharpening" characteristic is key for all kinetic energy penetrators to maintain the sharpness of the piercing head of the penetrator during penetration into the target, such that the maximum amount of kinetic energy is primarily used to damage the target. By reducing the penetrator head size through discarding material along plastic localizations, the penetrators may displace a smaller diameter penetration tunnel in the armor, thereby penetrating more efficiently and delivering superior ballistic performance. The rapid development of the flow and shear failure behaviors lead to a quick discarding of the penetrator material, which would otherwise build up at the head of the projectile. This head-sharpening material shed—enabled by flow softening and adiabatic shear banding helps deliver a superior ballistic performance by effectively conserving the kinetic penetration energy.

This "self-sharpening" effect is rooted in a material's propensity to adiabatic shear localization or banding when under uniaxial dynamic (high strain rate) compression or loading. Overall, adiabatic shear banding is a failure pattern of materials at high strain rates. This adiabatic shear localization occurs when thermal softening overcomes both strain hardening and strain rate hardening effects.

Pure refractory metals—i.e., titanium, vanadium, chromium, zirconium, niobium, molybdenum, ruthenium, rhodium, hafnium, tantalum, tungsten, rhenium, osmium, and iridium—may exhibit adiabatic shear banding or adiabatic shear localization. More specifically, BCC metals and alloys with severe plastic deformation tend to develop adiabatic shear banding under dynamic compression or high strain rate loading. Iron, since it has BCC structure at ambient temperature, also shows adiabatic shear localization under similar loading conditions. In particular, these refractory metal materials exhibit adiabatic shear banding under uniaxial dynamic (high strain rate) loading, where an applied severe plastic deformation process has refined their grain size into either the ultrafine grain (with grain size larger than 100 nm, but less than 1000 nm) or nanocrystalline (with grain size less than 100 nm) regime. However, prior to the present disclosure, these metals (e.g., tungsten), even after undergoing severe plastic deformation methods, have not yet been able to be incorporated as a primary material in kinetic energy penetrators due to strict dimensional limitations.

Refractory metals are widely defined as titanium, vanadium, chromium, zirconium, niobium, molybdenum, ruthenium, rhodium, hafnium, tantalum, tungsten, rhenium, osmium, and iridium. This specific class of metals features high melting points (above 2,123 K) as well as strong heat- and wear-resistance. The high melting point property of the refractory metals class ties to a characteristically superior creep deformation resistance. The mass densities of refractory metals range from about 4.5 g/cm$^3$ to about 23 g/cm$^3$ (even greater than uranium's).

The adiabatic shear banding phenomenon has been studied in terms of high strain rate deformation (such as high-velocity punching and forming, high-speed machining, cryogenic deformation, ballistic testing, etc.) through experiments and mathematical methods to examine the shear localization and its temperature dependence. The results for stainless steels showed that temperatures as high as the melting temperature were reached throughout the shear band shortly after the peak load was attained. By contrast, in a tantalum shear band, the observed temperature rise (from room temperature to about 898 K) was less than the steels' calculated results. Validation of such temperature increases is very difficult to measure experimentally. This adiabatic shear banding may also be evaluated in metallic glass and composite materials using instrumented indentation tests and ballistic tests, respectively.

In 1943, Zener and Hollomon first recognized the relationship between plastic deformation and loading strain rate in steels. Since then, much research has been conducted to develop criteria to explain this plastic instability. Recht developed a hypothesis that high strain rate plastic behavior was influenced by temperature gradients—a function of thermophysical properties, strain rate, and shear strength. In 1981, Bai derived a criterion for thermo-plastic shear instability, in which titanium initialized instability at low strains, and this instability developed fully at high strain rates. However, for mild steel, this phenomenon was reversed. Then, Bai calculated the width of a shear band to be approximately 10-100 μm.

In contrast to the above, a twinning induced plasticity steel with a composition of Fe-15Mn-2.5Si-2Al-0.6C and a face-centered-cubic (FCC) lattice structure has been found to exhibit strong strain and strain rate hardening upon the mechanical loading, resulting in outstanding adiabatic shear banding resistance. The strain and strain rate hardening mechanisms have been experimentally investigated as a function of strain rate under uniaxial tension and compression. The steel sample is characterized by a constant strain hardening rate as well as by high strength and high ductility under tension. This extraordinarily strong strain rate hardening behavior in the context of deformation kinetics is described as high strain rate sensitivity and low activation volume compared with coarse-grained FCC counterparts. It has been discovered that a marginal size effect exists in this twinning induced plasticity steel. This size effect is believed to be due to an extremely small activation volume. According to the Zener-Hollomon equation, increasing the strain rate has an equivalent effect to that of a decrease in deformation temperature which favors the formation of twins with small thickness and spacing.

FIG. 1 shows a schematic of a heterogeneous multilayer structure and/or composition 100 with alternating layers of a refractory metal material 102 and an interlayer material 104.

The refractory metal material layer 102 may include titanium, vanadium, chromium, zirconium, niobium, molybdenum, ruthenium, rhodium, hafnium, tantalum, tungsten, rhenium, osmium, and/or iridium. The interlayer material layer 104 may include iron, nickel, carbon, aluminum, silicon, and/or manganese.

The refractory metal material layers 102 may be diffusion bonded to the interlayer material layers 104, such as through a diffusion welding process using a hot press, for example. To diffusion weld material layers 102 and 104 together, pressure may be added inside a heated furnace full of argon gas.

The grain size, crystallite size, or grain diameter of a material is inversely proportional to the material's yield strength. The ultrafine grain regime of materials is defined by having an average grain size between about 100 nm and about 1000 nm. The next level beyond ultrafine, having higher yield strength and smaller average grain size, is the nanocrystalline regime of materials, in which the average grain size is less than about 100 nm. The upper limit on material yield strength based on refined grain microstructure occurs around an average grain size of about 10 nm, since below this diameter, grains are susceptible to grain boundary sliding.

Severe plastic deformation is the application of high strains to a material that increases the material's defect density such that its grain size is refined to be within the ultrafine grain or nanocrystalline regime. In preparing the heterogeneous multilayer structure 100, the refractory metal material layer 102 may undergo severe plastic deformation through various cold-working processes, such as two-step or multi-step cross rolling, for example. Any alternative methods may be used to generate dislocations within the refractory metal material 102, such as other cold-working techniques, accumulative roll bonding, milling, and/or surface treatments.

The thickness of the refractory metal material layer 102 may be from about 100 μm to about 800 μm. For example, the refractory metal material layer 102 may be about 465 μm thick.

The thickness of the interlayer material layer 104 may be from about 10 μm to about 50 μm. For example, the interlayer material layer 104 may be about 25 μm thick.

Figure 2:
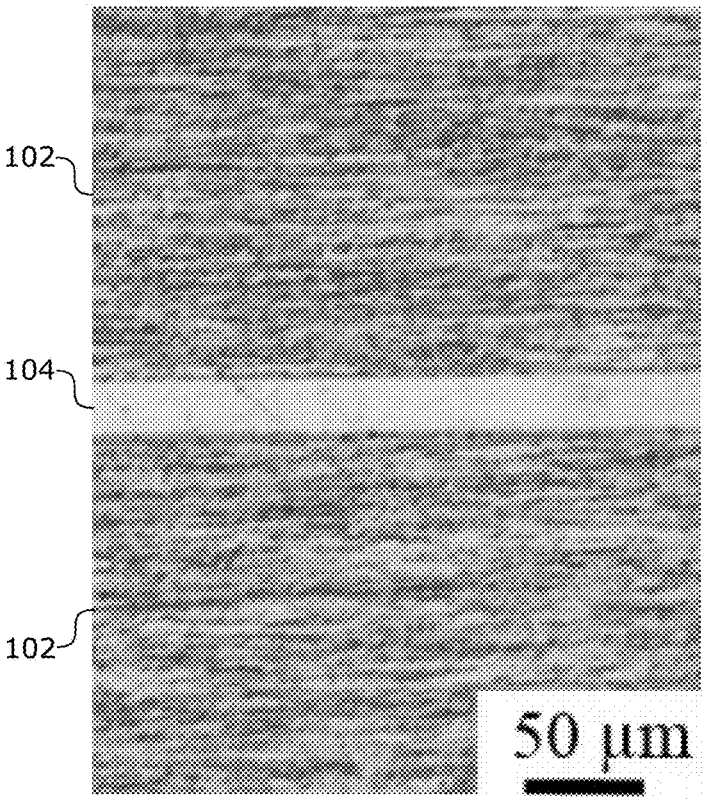
FIG. 2 shows an image of a diffusion bonded heterogeneous multilayer structure with alternating layers of tungsten and iron, in accordance with certain embodiments of the disclosed technology.

FIG. 2 shows an image of a diffusion bonded heterogeneous multilayer structure 100 with alternating layers of a refractory metal material 102, including tungsten, and an interlayer material layer 104, including iron.

Figure 3:
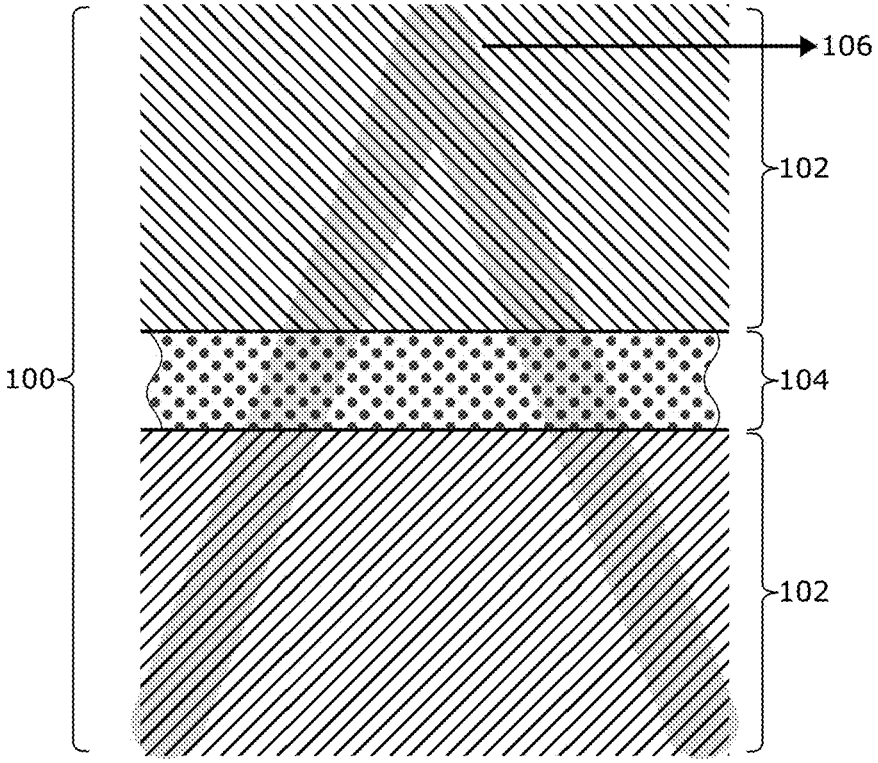
FIG. 3 shows a schematic of adiabatic shear banding propagating through the heterogeneous multilayer structure of FIG. 1, in accordance with certain embodiments of the disclosed technology.

Moreover, the inhomogeneous stacking of heterogeneous multilayer structure 100 may cause adiabatic shear banding to be propagated through the composition 100, resulting in the desired "self-sharpening" effect, as shown in FIG. 3.

FIG. 3 shows a schematic of adiabatic shear banding propagating through the heterogeneous multilayer structure 100 of FIG. 1. When the heterogeneous multilayer structure 100 is subjected to high impact loads, an adiabatic shear band 106 may develop across the refractory metal material layers 102 and the interlayer material layers 104.

Figure 4:
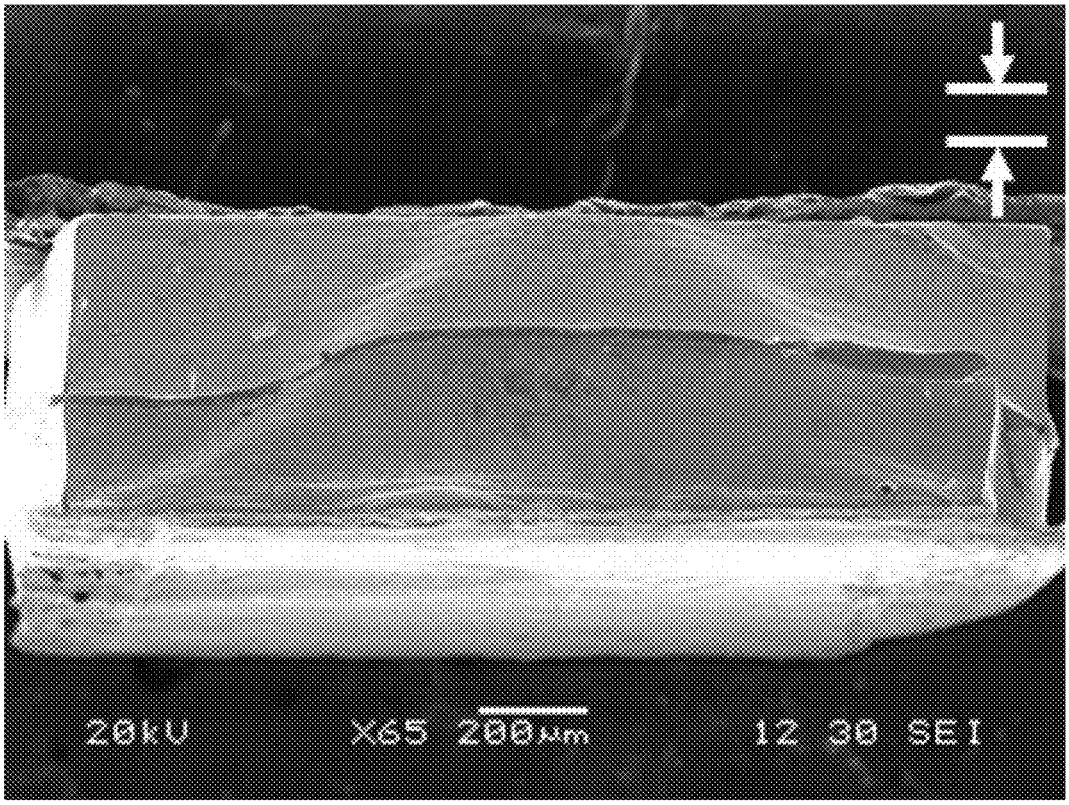
FIG. 4 shows an image of adiabatic shear banding observed in the multilayer structure of FIG. 2 upon impact loading, in accordance with certain embodiments of the disclosed technology.

FIG. 4 shows an image of adiabatic shear banding 106 observed in the multilayer structure 100 of FIG. 2 upon impact loading.

Figure 5:
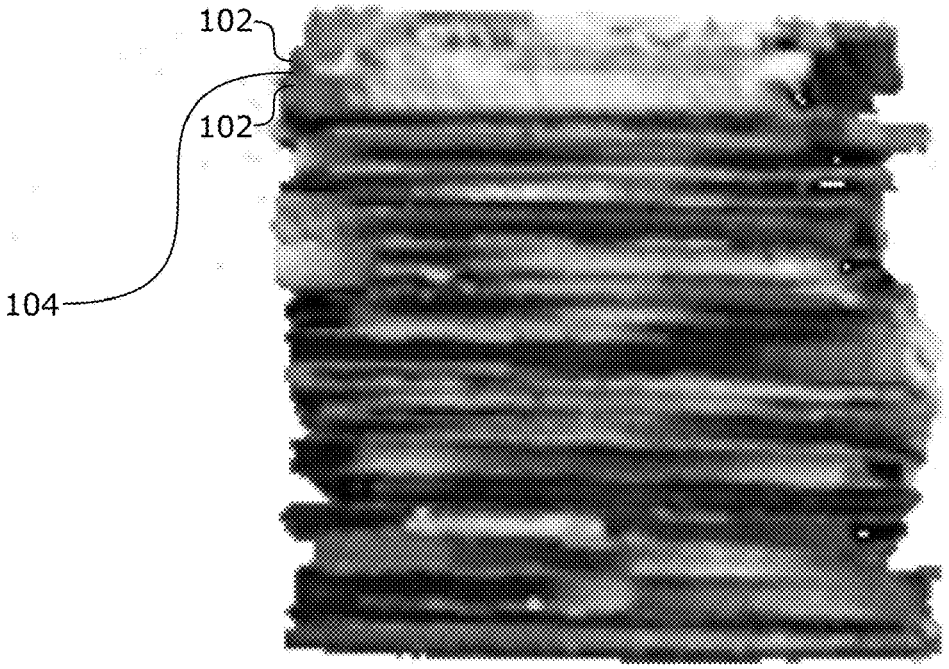
FIG. 5 shows a side-view image of a heterogeneous multilayer structure prepared by diffusion bonding, in accordance with certain embodiments of the disclosed technology.

In some embodiments, as shown in FIGS. 1-2, by stacking tungsten 102 and binding interlayers 104 in an alternating fashion, a hierarchical structure 100 may be achieved without dimensional limitations. FIG. 5 shows a side-view image of a heterogeneous multilayer structure 100 of alternating refractory metal material layers 102 and interlayer material layers 104, 11 mm×12 mm, stacked 11.75 mm tall, prepared by diffusion bonding.

Figure 6:
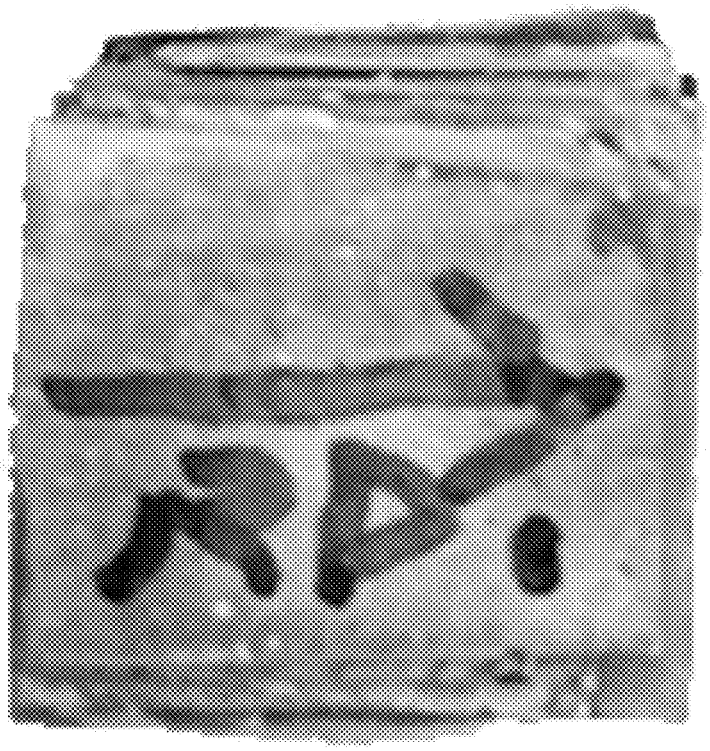
FIG. 6 shows a top-view image of the heterogeneous multilayer structure of FIG. 5 prepared by diffusion bonding and indicating the rolling direction of the plasticly-deformed refractory metal material layer, in accordance with certain embodiments of the disclosed technology.

FIG. 6 shows a top-view image of the heterogeneous multilayer structure 100 of FIG. 5, indicating the rolling direction of the cold-worked refractory metal material layers 102. Using this heterogeneous multilayer structure 100 of FIGS. 5-6, subscale heterogeneous projectiles were fabricated for ballistic testing.

The performance of prototype or subscale kinetic energy penetrators may be evaluated using a ballistic testing method where projectiles are fired into a steel target (or other target material) at strain rate up to about $10^6$ $s^{-1}$ in an indoor small-scale test range facility. By measuring and examining the diameter of the penetration tunnel formed through the armor plate or target material, the ballistic performance may be compared and evaluated.

When comparing the depth and morphology of a penetration tunnel created by depleted uranium alloy penetrators with those of conventional tungsten-based heavy alloy penetrators, experiments have shown that the penetration tunnels produced by the depleted uranium alloy penetrators were narrower and deeper than the ones created by conventional tungsten-based heavy alloy penetrators. Moreover, conventional tungsten-based heavy alloy penetration tunnels were often more deteriorated because of the increased diameter caused by excessive plastic deformations at the conventional tungsten-based heavy alloy penetrator's piercing head, which further demonstrated a poor ballistic performance as compared to a depleted uranium alloy penetrator.

Figure 7:
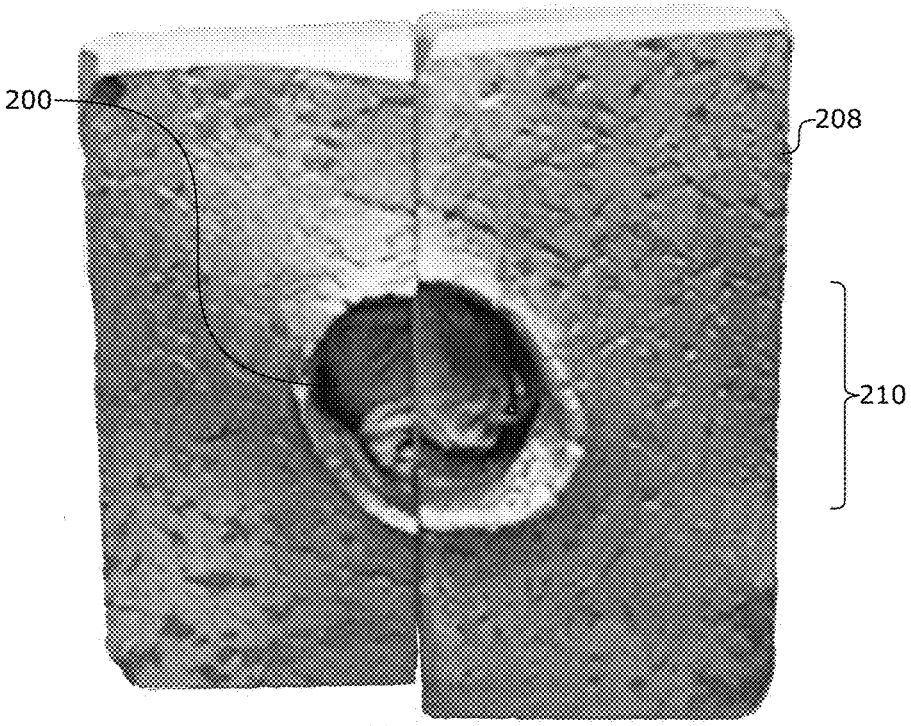
FIG. 7 shows a back-facing view of a penetration tunnel in a halved target material created by a heterogenous multilayer stacked kinetic energy penetrator, in accordance with certain embodiments of the disclosed technology.

FIG. 7 shows a back-facing view of the result of the ballistic testing method—a heterogenous multilayer stacked kinetic energy penetrator 200 after having been thrust into a target material 208, thereby creating a penetration tunnel 210, which now halved reveals the compacted and embedded penetrator 200.

Figure 8:
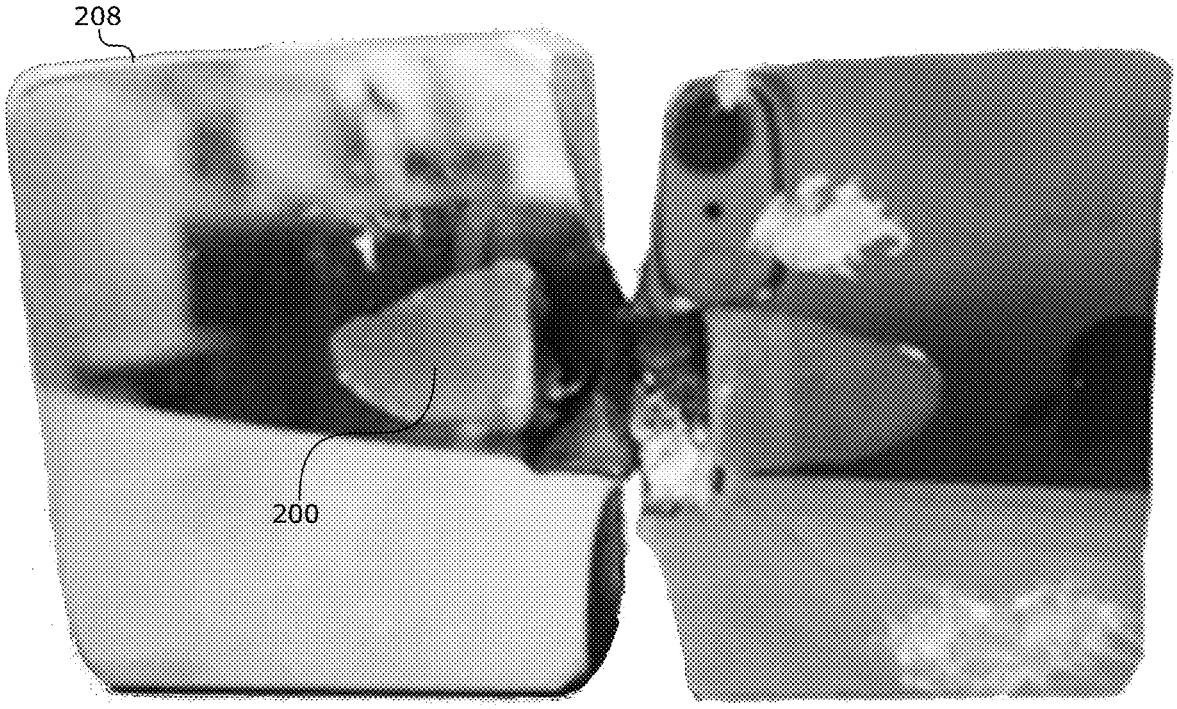
FIG. 8 shows a cross-sectional side view of the heterogenous multilayer stacked kinetic energy penetrator of FIG. 7 embedded into halved target material, in accordance with certain embodiments of the disclosed technology.

FIG. 8 shows a cross-sectional side view of the heterogenous multilayer stacked kinetic energy penetrator 200 of FIG. 7 compressed into the end of the penetration tunnel 210, embedded in the halved target material 208.

Figure 9:
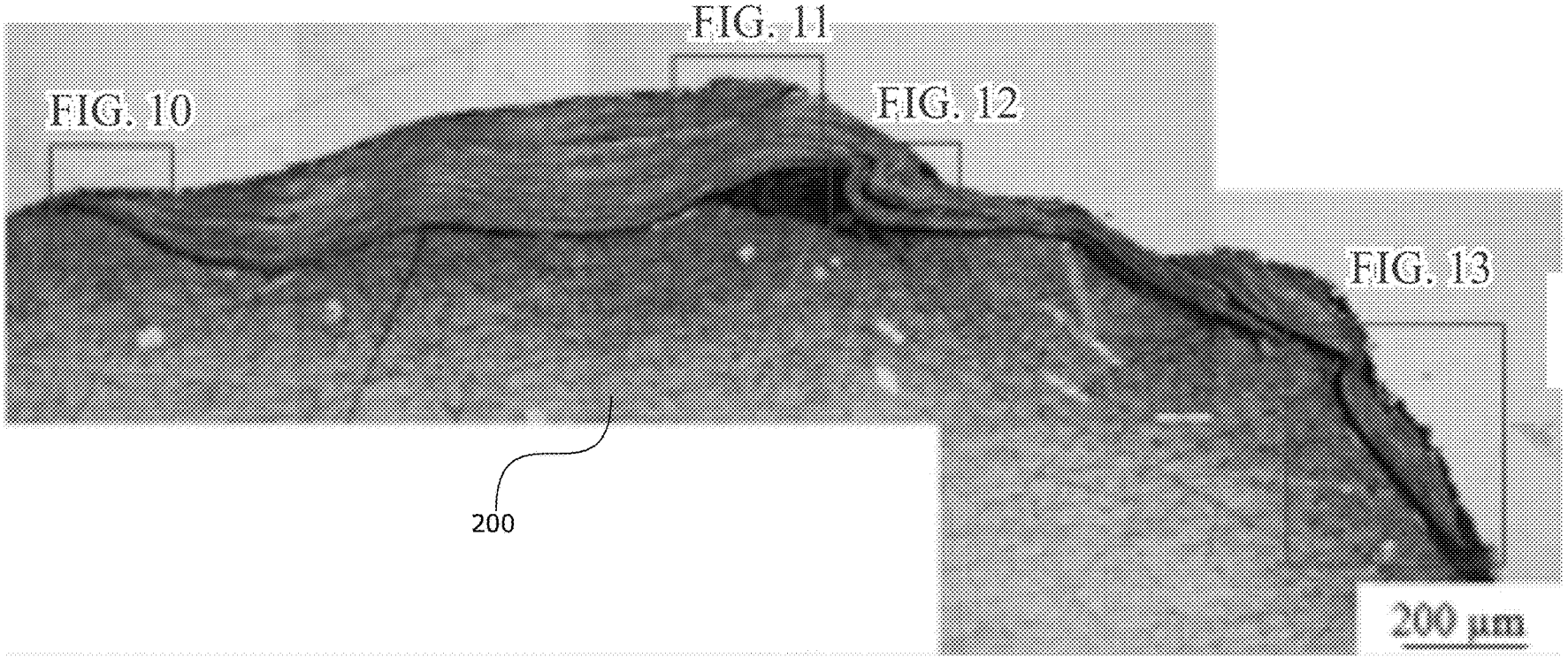
FIG. 9 shows an assembled optical micrograph mapping of the projectile residues of the kinetic energy penetrator of FIGS. 7-8 within the target material, in accordance with certain embodiments of the disclosed technology.
Figure 10:
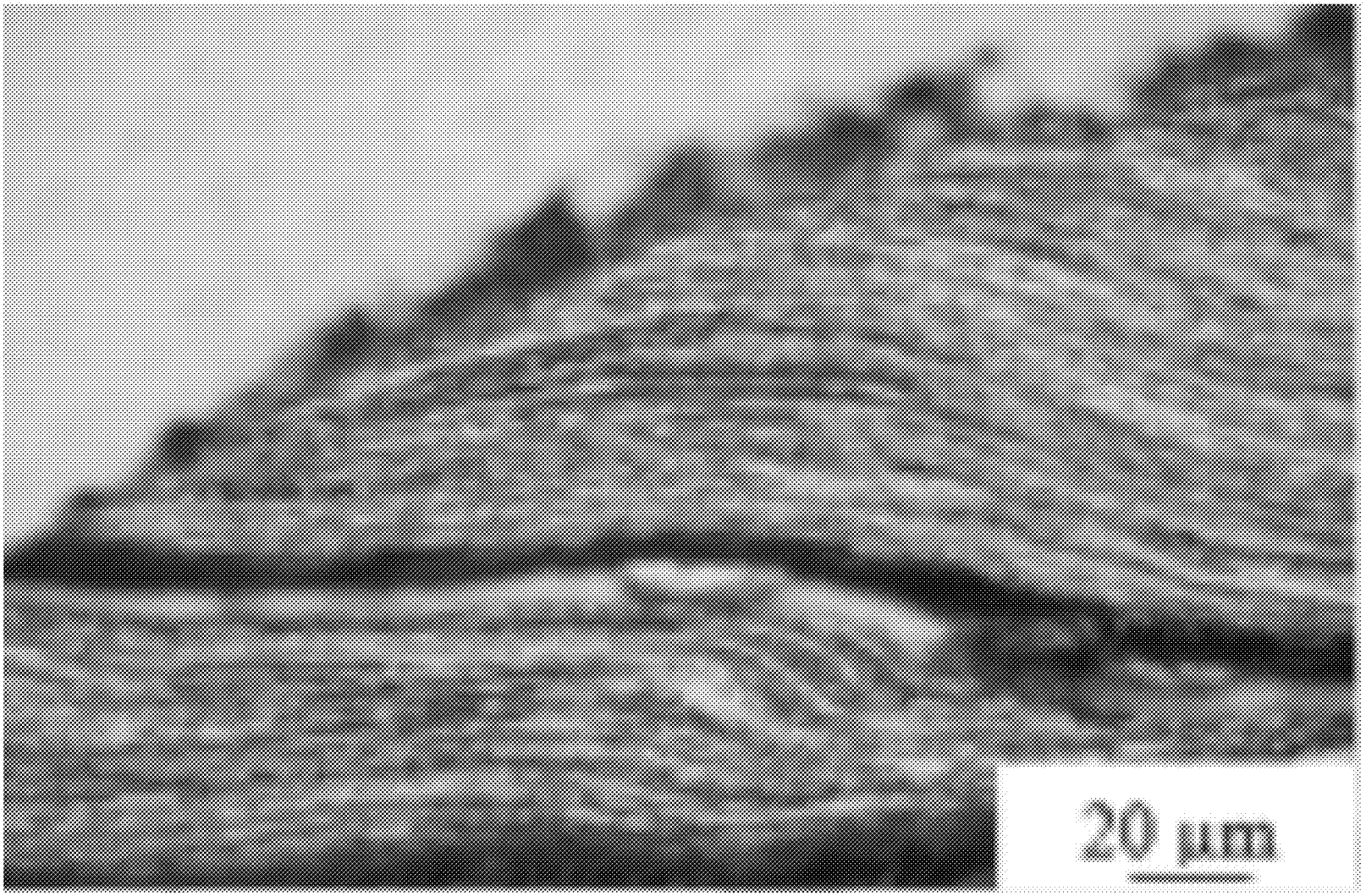
FIG. 10 shows an enlarged section of the optical micrograph of FIG. 9 illustrating the adiabatic shear banding behavior of the kinetic energy penetrator of FIGS. 7-8 having a heterogenous multilayered structure, in accordance with certain embodiments of the disclosed technology.
Figure 11:
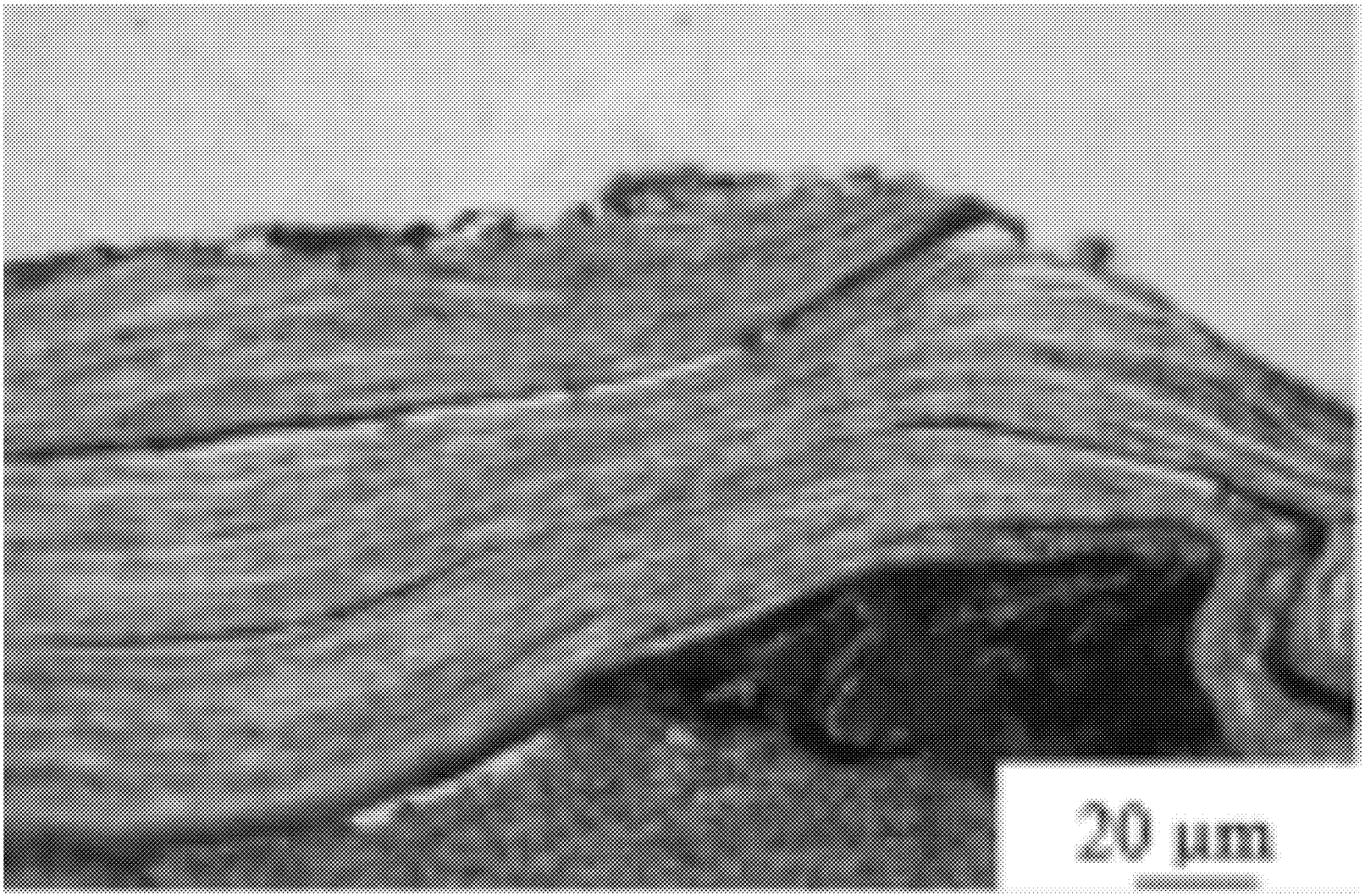
FIG. 11 shows another enlarged section of the optical micrograph of FIG. 9 illustrating the adiabatic shear banding behavior of the kinetic energy penetrator of FIGS. 7-8 having a heterogenous multilayered structure, in accordance with certain embodiments of the disclosed technology.
Figure 12:
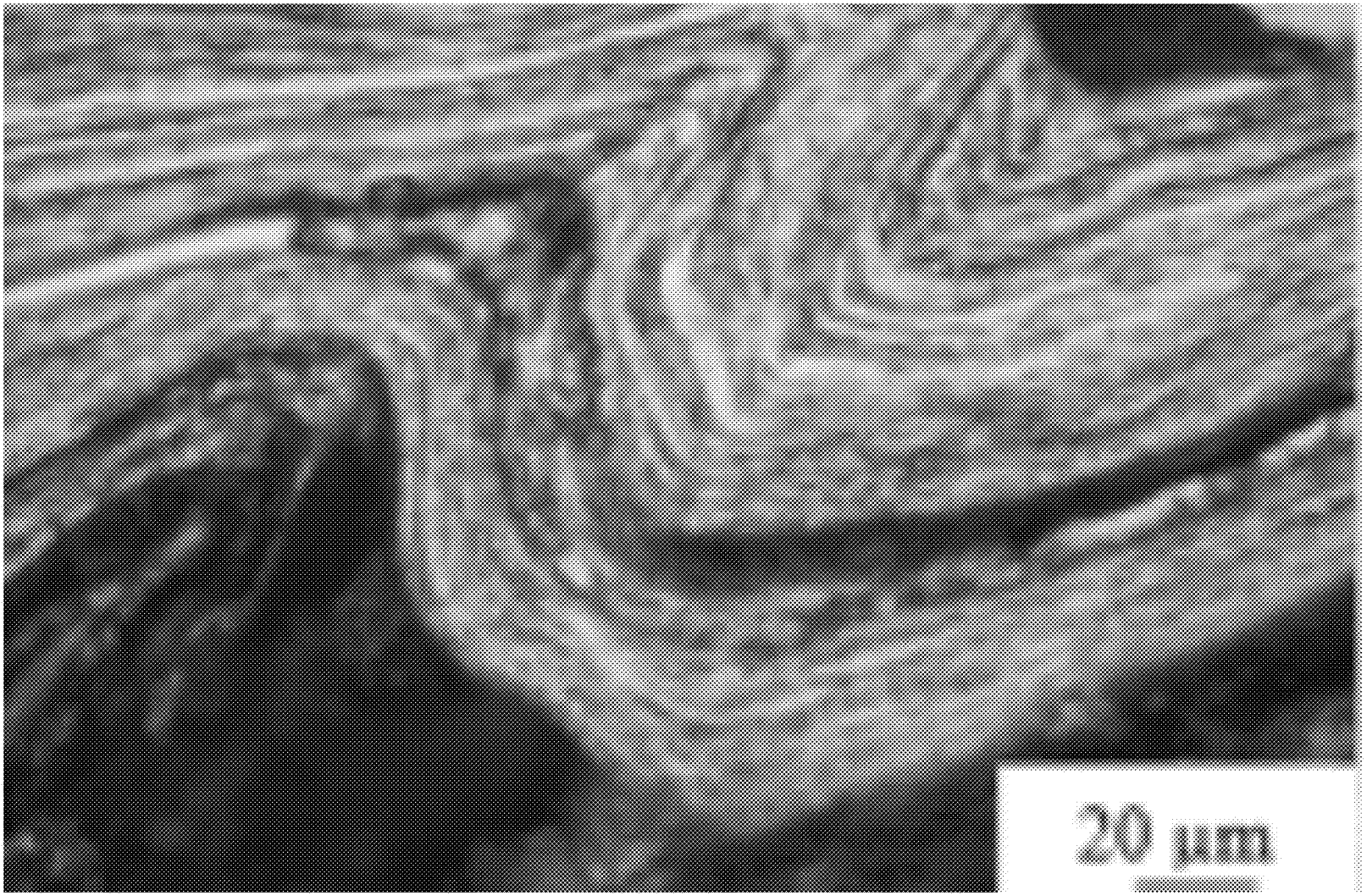
FIG. 12 shows yet another enlarged section of the optical micrograph of FIG. 9 illustrating the adiabatic shear banding behavior of the kinetic energy penetrator of FIGS. 7-8 having a heterogenous multilayered structure, in accordance with certain embodiments of the disclosed technology.
Figure 13:
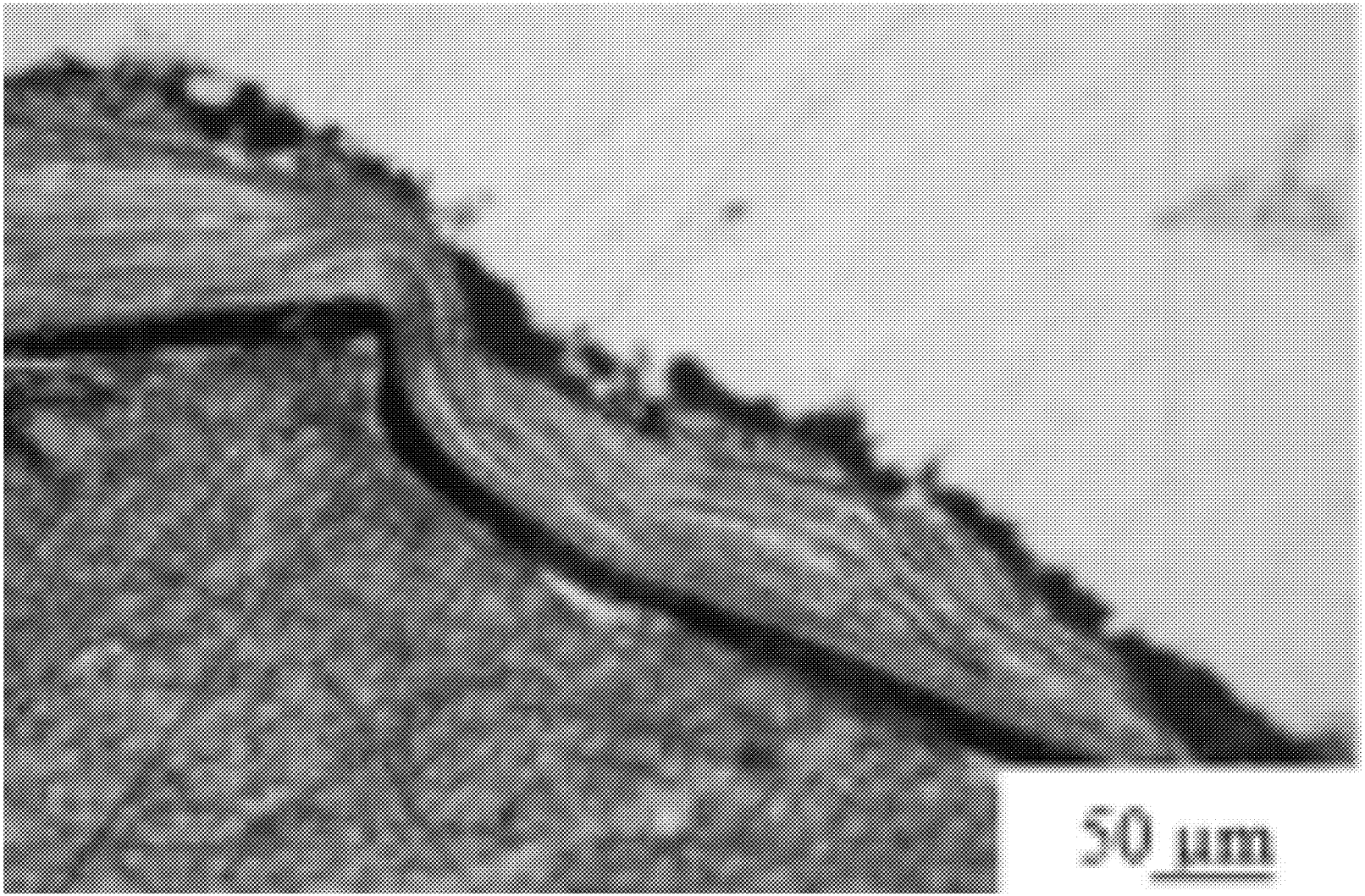
FIG. 13 shows a final enlarged section of the optical micrograph of FIG. 9 illustrating the adiabatic shear banding behavior of the kinetic energy penetrator of FIGS. 7-8 having a heterogenous multilayered structure, in accordance with certain embodiments of the disclosed technology.

FIG. 9 shows an assembled optical micrograph mapping of the projectile residues of the kinetic energy penetrator 200 of FIGS. 7-8 implanted within the target material 208. Adiabatic shear bandings identified at the head of the projectile residuals suggest an early onset of shear localization behavior during the ballistic event. The adiabatic shear bandings were observed to propagate through the heterogeneous layers and the bonding interfaces remained intact upon high rate loading.

FIGS. 10-13 show enlarged sections of the optical micrograph of FIG. 9 illustrating the adiabatic shear banding behavior of the heterogenous multilayer stacked kinetic energy penetrator 200 of FIGS. 7-8 produced while tunneling into the target material 208. Notably, there is a lack of bulging deformations along the piercing head of the kinetic energy penetrator 200. This indicates a much higher kinetic energy conservation efficiency than exhibited in conventional tungsten-based heavy alloy penetrators.

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims for all purposes.

What is claimed is:

1. A method of making material for kinetic energy penetrator applications, the method comprising:

severely plasticly deforming a refractory metal material until the grain size of the refractory metal material is within one of ultrafine grain and nanocrystalline regimes, thereby forming refractory metal material layers;

arranging an interlayer material between the refractory metal material layers; and diffusion bonding the interlayer material to the refractory metal material layers.

2. The method of claim 1, wherein the grain size is greater than about 100 nm.

3. The method of claim 1, wherein the grain size is less than about 100 nm.

4. The method of claim 1, wherein severely plasticly deforming the refractory metal material is achieved through cold rolling.

5. The method of claim 1, wherein the refractory metal material includes at least one of titanium, vanadium, chromium, zirconium, niobium, molybdenum, ruthenium, rhodium, hafnium, tantalum, tungsten, rhenium, osmium, and iridium.

6. The method of claim 1, wherein the interlayer material includes iron.

7. The method of claim 1, wherein arranging the interlayer material between the refractory metal material layers is achieved through stacking the interlayer material atop one of the refractory metal material layers.

8. The method of claim 1, wherein diffusion bonding the interlayer material to the refractory metal material layers is achieved using a hot press.

* * * * *